US006805575B2

(12) United States Patent
Lappöhn et al.

(10) Patent No.: US 6,805,575 B2
(45) Date of Patent: Oct. 19, 2004

(54) GUIDE SYSTEM FOR CONTACT PLUGS

(75) Inventors: Jürgen Lappöhn, Gammelshausen (DE); Peter Aichem, Göppingen (DE)

(73) Assignee: ERNI Elektroapparate GmbH, Adelberg (DE)

( * ) Notice: Subject to any disclaimer, the term of this patent is extended or adjusted under 35 U.S.C. 154(b) by 0 days.

(21) Appl. No.: 10/279,942

(22) Filed: Oct. 24, 2002

(65) Prior Publication Data

US 2003/0082944 A1 May 1, 2003

(30) Foreign Application Priority Data

Oct. 25, 2001 (DE) ..... 201 17 303 U

(51) Int. Cl.[7] ..... H01R 13/63
(52) U.S. Cl. ..... 439/381
(58) Field of Search ..... 439/378–381, 439/357–358, 364, 681, 359, 297, 298

(56) References Cited

U.S. PATENT DOCUMENTS 4,998,892 A 3/1991 Shiley
5,391,091 A * 2/1995 Nations ..... 439/378
6,074,235 A * 6/2000 Brandberg et al. ..... 439/378

FOREIGN PATENT DOCUMENTS

| | | |
|---|---|---|
| DE | 89 04 564 | 6/1990 |
| DE | 296 22 993 | 3/1998 |
| DE | 199 44 705 | 4/2002 |
| EP | 0 863 580 | 3/1998 |

* cited by examiner

*Primary Examiner*—J. F. Duverne
(74) *Attorney, Agent, or Firm*—Collard & Roe, P.C.

(57) ABSTRACT

A connection system for two electrical components, in particular for plugs, multipoint plugs and female multipoint connectors as well as plug-in cards, circuit boards and similar things, has a pin (1), arranged at the first component, and a socket (2) for receiving the pin (1), arranged at the second component. The pin (1) penetrates an opening at the wall section (3) of the first component and is attached with a nut (5) that can be screwed onto the pin (1) at the rear side of this wall section (3). The pin (1) is furnished with a flange (6) that projects over the pin (1) at its circumferential surface. The flange (6) is inserted into a recess of a spacer plate (7) complementary to the flange (6), and the spacer plate (7) is arranged at the wall section (13) of the first component.

9 Claims, 2 Drawing Sheets

GUIDE SYSTEM FOR CONTACT PLUGS

BACKGROUND OF THE INVENTION

CROSS REFERENCE TO RELATED APPLICATIONS

Applicants claim priority under 35 U.S.C. §119 of German Application No. 201 17 303.4 filed Oct. 25, 2001.

1. Field of the Invention

The present invention relates to systems which connect electrical components with each other in a correct or predetermined position.

2. The Prior Art

Devices or systems which connect electrical components with each other are known and common in a variety of diverse embodiments. These systems connect in the correct position various electrical components with each other, including electrical contacts, plugs, multi-contact strips, multipoint plugs and female multipoint connectors as well as printed circuit boards, boards and similar things. These systems perform the function of connecting sensitive electrical conductive components, e.g. multipoint plugs or female multipoint connectors, in the correct position with each other and so that when the components are inserted into each other to make an electrical contact, bending and damaging of the components can be avoided.

Connection systems are known which have a so-called pin which penetrates an opening that is provided in a wall section that usually protrudes sideways over the first electrical component. In order to attach the pin to this first wall section or the first component, a nut is screwed onto the pin on the rear side, i.e. on the side, which points away from the second component. In this way the pin can be replaced, e.g. when there is damage to the pin as the result of incorrect insertion.

Starting from this state of the art, one skilled in the art has the task of improving a connection system so that the pin is arranged at the first component in a way that prevents the pin from being twisted.

SUMMARY OF THE INVENTION

For that purpose, the system has a pin, which protrudes over the component on which it is arranged. It protrudes toward the direction where the two components are connected so that the pin can be inserted into a complementary formed socket at the other component. The protruding design of the pin guarantees that the electrical contacts themselves will be connected with each other in the correct position.

In accordance with the invention, a guide system for contact plugs and other electrical components is provided in which the pin is furnished with a flange that projects over the pin at its circumferential surface, the flange is inserted into a recess of a spacer plate complementary to the flange, and the spacer plate is arranged at the wall section of the first electrical component to be connected. Advantageous embodiments of the invention are discussed below.

The central idea of the invention is that with the new guide system, a flange is formed at the pin which protrudes over its circumferential surface. In general, this pin has a generally uniform cross-section over its axial extension. The cross section is extended or changed by projections protruding over the remaining circumferential surface only at the point of the flange. In so doing, this flange is placed in accordance with the invention in a recess of a spacer plate so that the pin is attached to the spacer plate, relative to its longitudinal axis. The pin is thus secure from being twisted relative to the spacer plate. The spacer plate for its part is likewise arranged at the wall section of the first component so as to be secured against twisting with regard to the wall section.

The advantage of the invention is that it avoids an axial twisting of the pin relative to the component on which it is arranged. Also avoided, therefore, is an unintentional loosening of the screw connection made by a nut at the rear side of the wall section.

A socket is arranged on the second component which is to be connected to the first component. The socket has an opening which points in the direction of the pin. This opening is provided with a conical extension, preferably in the form of a funnel. This is done to facilitate the introduction of the pin into the socket. In the same way, the tip of the pin, which points toward the socket, can be formed conically or tapered or rounded.

The spacer plate and/or the socket may also be provided with further alignment devices preferably in the form of projections, in order to get an exact alignment of the two components with respect to each other. For example, these projections may hang over the spacer plate in the direction of the insertion. The alignment device arranged on the socket is furnished with complementary formed projections and/or indentations, which mesh with the projections of the spacer plate. This is done in order to align the two components in the correct position with respect to each other. Thus, the two components can be aligned exactly with respect to each other. The projections or the additional alignment devices are formed so that an exact alignment takes place before the actual connection of the electrical contact elements, e.g. multipoint plugs or female multipoint connectors.

In order for the pin to be resilient, it must be made from a metal so that it can be produced easily, yet economically. In so doing, the electrical pin as well as the socket, in which it is inserted, is preferably electrically contacted in order to create thereby a ground between the two components, in particular before the additional contact elements themselves are connected with each other. Thus, possible damage from the discharge of static electricity is avoided. For that purpose, the socket can either be itself constructed completely of metal with a corresponding connection to the ground or the socket can be formed, or for example layered, at least in sections on the inner side so that it can conduct electricity.

Furthermore, in order to achieve a long-lasting connection of the two components to each other, a reduction or an expansion of the area of the cross-section at the pin may be made so as to form a lock-in projection or slot, which operates together with a correspondingly formed lock-in projection on the inside of the socket. For this reason the lock-in element is formed preferably as a reduction of the area of the cross-section that extends around the pin. Likewise, such lock-in projections/cross-section area reductions can also be arranged at the previously described projections of the additional alignment devices.

To align the pin in the correct position vis-à-vis the spacer plate or the first component, the flange may be formed as two projections on opposite sides of one another in a correspondingly formed recess of the spacer plate. These two radial protruding arms or sections prevent the pin from twisting when the pin is inserted. Conceivably, however, the flange may take any other shape, including round and asymmetrical shapes. For example, the flange may take the form of a polygon, such as a triangle, a rectangle, a pentagon or a hexagon.

In a further embodiment, the spacer plate with the alignment devices arranged on it as well as the socket with correspondingly formed projections/indentations may be made from plastic components each formed of one piece. The plastic components in particular can be manufactured simply in an injection molding process.

In this embodiment, the respective element of the connection device may be attached to the respective wall sections of the components to be connected to each other by inserting further projections into additional openings of these wall sections. The elements can also for example be fastened securely with an additional screw to these wall sections.

When the socket is made from plastic, the electrical contacting for production of a bonding, for example, occurs by providing electrically conductive layers on the inside of the socket so it is correspondingly contacted. As a matter of principle, the socket may also take the form of a pipe and be openly formed on the end opposite the opening, so that the pin projects over the pipe at this other end and, for its part, can be contacted electrically at the second component.

An electrically contacted, mechanical spring is arranged at the socket. This spring penetrates the casing of the socket in order to generate an electrical contact, specifically a grounding contact, between the spring and the pin when the pin is pushed into the socket. In this way a grounding is achieved before the actual electrical contacts touch each other. When the pin is in a retracted position, the spring can also engage an indentation in the pin to lock the spring into place.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
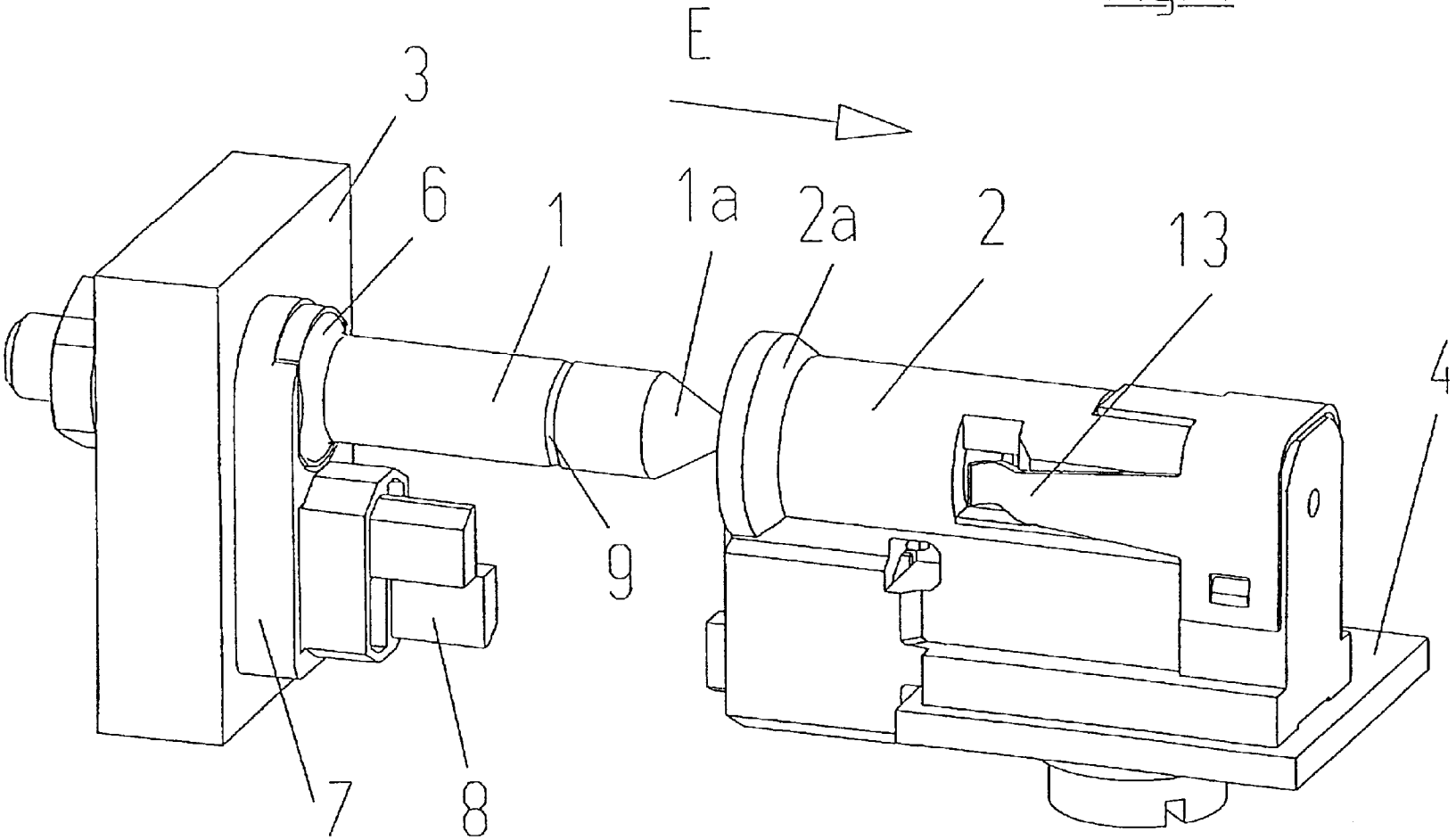
FIG. 1 shows a connection system in a perspective view.
Figure 2:
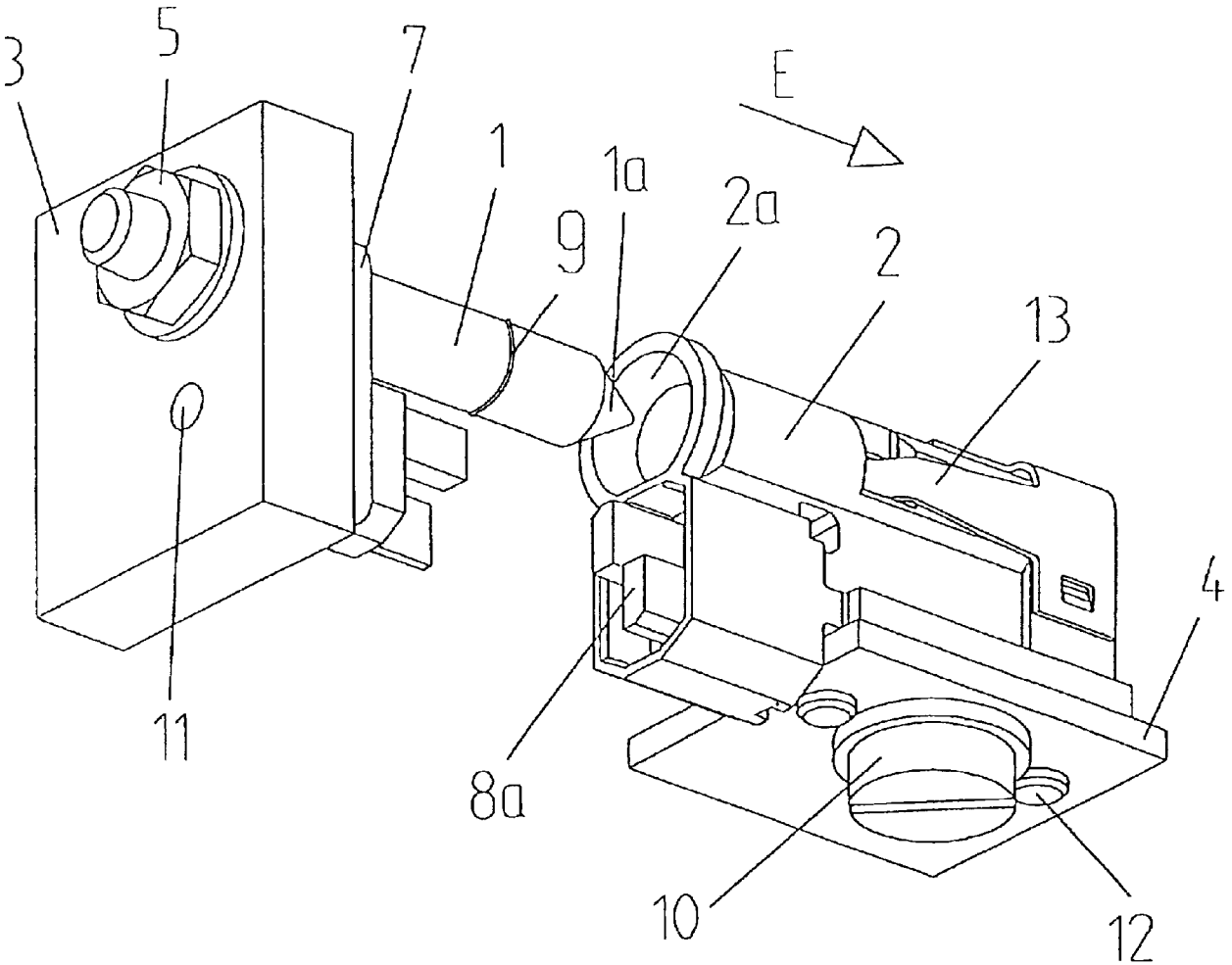
FIG. 2 shows an additional perspective view of the connection system of FIG. 1.

Referring to FIGS. 1 and 2, there is shown a connection system for two electrical components of a preferred embodiment. The system includes a spacer plate 7 having a recess arranged at a wall section 3 of the first component. A pin 1, preferably a metal pin, penetrates spacer plate 7 as well as wall section 3. Pin 1 has a flange 6 that projects over the circumference of pin 1. The flange is inserted in the recess of the spacer plate.

A socket 2 for receiving pin 1 is arranged at a second wall section 4 of the second electrical component. Preferably, socket 2 and wall section 4 are plastic components formed by injection molding. To connect both electrical components with each other, the electrical components are moved toward each other so that pin 1 is introduced into socket 2 in the insertion direction "E", as indicated by the arrow. To facilitate the introduction of pin 1 into socket 2, pin 1 has a conically tapered tip 1*a*, and the opening 2*a* of socket 2 is provided with a conical extension.

Further alignment devices 8, 8*a* are provided at spacer plate 7 and socket 2 for aligning both electrical components in a predetermined correct position with respect to each other. These alignment devices 8, 8*a* take the form of projections and recesses corresponding to each other and may be each formed as one piece at spacer plate 7 or socket 2, respectively. They can also be formed, however, as additional elements that are detachable and replaceable.

As is apparent in FIG. 2, one opening (e.g. a through hole 11) is provided in each of first wall section 3 and second wall section 4, in order to attach spacer plate 7 or socket 2 with the aid of a nut 5 or a screw 10. To align socket 2 as well as, if need be, spacer plate 7, pins 12 are formed in socket 2 and spacer plate 7, each of which engages and penetrates opening 11 in wall sections 3, 4.

Pin 1 is attached at the rear side of first wall section 3, which faces away from socket 2. A nut that can be screwed on to pin 1 and can be removed may be used to fasten pin 1 to first wall section 3.

As is apparent in FIG. 1, pin 1 has an area 9 of reduced cross-section extending around pin 1 for generating a lock-in slot, which can operate together and can be fastened and detached with a complementary formed lock-in catch, which is not depicted here, in the interior of socket 2.

A spring 13 is arranged at socket 2 so that an electrical contact, in particular a ground contact, can be produced between spring 13 and pin 1. Thus, it is possible to jointly ground the components to be connected, before the actual electrical contacts are meshed.

As is apparent from the foregoing, the connection system is suitable for plugs, multipoint plugs and female multiport connectors as well as plug-in cords, circuit boards, and similar electrical components.

While several embodiments of the present invention have been shown and described, it is to be understood that many changes and modifications may be made thereunto without departing from the spirit and scope of the invention as defined in the appended claims.

What is claimed is:

1. A connection system for connecting two electrical components, which comprises:

(a) a pin arranged on a first electrical component, said first electrical component having a first wall section including a rear side, and an opening in said first wall section, said pin penetrating said opening and being secured to said first electrical component by a nut screwed on to said pin at the rear side of said wall section;

(b) a flange projecting over a circumferential surface of said pin;

(c) a spacer plate arranged on said first wall section and having a recess complementary to said flange, said flange being inserted into said recess;

(d) a socket arranged on a second electrical component for receiving said pin;

(e) a first alignment device provided on said spacer plate; and (f) a second alignment device complementary to the first alignment device provided on said socket, said alignment devices connecting the first and second electrical components in a predetermined position.

2. A connection system according claim 1, wherein said socket has an opening formed as a conical extension and said pin has a conically tapered tip pointing toward said socket.

3. A connection system according to claim 1, wherein said pin comprises metal and said pin and said socket are electrically contacted with each other and connected with the ground.

4. A connection system according to claim 1 wherein said pin has a portion of reduced cross-sectional area to form a lock-in slot extending around said pin.

5. A connection system according to claim 1, wherein said flange comprises two projections located opposite one another.

6. A connection system according to claim 1 wherein said flange is asymmetrical.

7. A connection system according to claim 1, wherein said second electrical component has a second wall section and said socket is secured with a screw connection to the second wall section and said spacer plate is secured with a screw connection to the first wall section.

8. A connection system according to claim 1, wherein said socket has an open end facing away from said pin and said pin has a lock-in extension for attaching to said open end of said socket at an end of said pin that penetrates the socket.

9. A connection system according to claim 1, further comprising a spring having a lock-in mechanism provided on said socket for releasably engaging an indentation in said pin and making an electrical contact.

* * * * *